US011225761B2

(12) United States Patent
Doy et al.

(10) Patent No.: US 11,225,761 B2
(45) Date of Patent: Jan. 18, 2022

(54) MACHINE, SYSTEM, AND METHOD FOR CONTROLLING ROTOR DEPTH

(71) Applicant: Caterpillar Paving Products Inc., Brooklyn Park, MN (US)

(72) Inventors: Nathaniel Doy, Maple Grove, MN (US); Jason W. Muir, Andover, MN (US); Lee M. Hogan, Champlin, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/837,369

(22) Filed: Apr. 1, 2020

(65) Prior Publication Data

US 2021/0310202 A1 Oct. 7, 2021

(51) Int. Cl.
*E01C 23/088* (2006.01)
*E01C 23/01* (2006.01)

(52) U.S. Cl.
CPC ..... *E01C 23/088* (2013.01); *E01C 23/01* (2013.01)

(58) Field of Classification Search
CPC ..... E01C 23/088; E01C 19/004; E01C 23/01; B60G 2300/09
See application file for complete search history.

(56) References Cited

U.S. PATENT DOCUMENTS

| | | | | |
|---|---|---|---|---|
| 5,309,407 | A * | 5/1994 | Sehr | E01C 19/006 367/96 |
| 8,690,474 | B2 | 4/2014 | Jurasz et al. | |
| 8,764,118 | B1 | 7/2014 | Krishnamoorthy et al. | |
| 9,039,320 | B2 | 5/2015 | Snoeck et al. | |
| 10,386,866 | B2 * | 8/2019 | DeLong | G05D 13/62 |
| 10,458,078 | B2 | 10/2019 | Berning et al. | |
| 10,465,346 | B2 | 11/2019 | Hoffman et al. | |
| 2008/0153402 | A1 * | 6/2008 | Arcona | B24B 7/188 451/352 |
| 2011/0121633 | A1 * | 5/2011 | Hall | G07C 3/02 299/39.2 |
| 2014/0097665 | A1 * | 4/2014 | Paulsen | G01B 11/00 299/39.4 |
| 2015/0117951 | A1 * | 4/2015 | Schlenker | E01C 23/088 404/84.05 |
| 2016/0258119 | A1 * | 9/2016 | Krolnik | E01C 23/088 |
| 2018/0340302 | A1 | 11/2018 | Menzenbach et al. | |
| 2019/0258119 | A1 | 8/2019 | Park et al. | |

* cited by examiner

*Primary Examiner* — Carib A Oquendo
(74) *Attorney, Agent, or Firm* — Xsensus LLC

(57) ABSTRACT

A milling machine, system, and method for adjusting a rotor cutting height adjusts the rotor cutting height to a target cutting height responsive to a control input received at an operator control interface. One or more legs of the milling machine and/or a height of the rotor can be adjusted to adjust the rotor cutting height to the target cutting height. The rotor cutting height can be adjusted based on data from one or more sensors. Each sensor may be a sonic sensor or an image capturing sensor.

14 Claims, 9 Drawing Sheets

MACHINE, SYSTEM, AND METHOD FOR CONTROLLING ROTOR DEPTH

TECHNICAL FIELD

The present disclosure relates to a milling machine, and more particularly to controlling rotor depth of the milling machine during a working operation.

BACKGROUND

During a working operation of a milling machine, such as a rotary mixer or a cold planer, it may be desirable to maintain a consistent working depth (e.g., cutting, mixing, milling, etc. depth). However, depth of the rotor may deviate from a target depth due to changes during the working operation, such as changes in ground profile, changes in material conditions, or various interactions between the milling machine and the ground surface. Such deviation may go unnoticed by the operator, and even if noticed may be cumbersome for the operator to monitor and adjust.

U.S. Patent App. Pub. No. 2018/0340302 ("the '302 publication") describes controlling a milling depth of a milling machine. According to the '302 publication, if milling depth sensors detect a deviation of the sensor values from predetermined values, then the milling depth is corrected. The '302 publication also describes that if a deviation of the sensor value from the predetermined value is determined for only one side, then the height of the machine frame is adjusted solely on that side. The '302 publication further describes changing the height and incline of the milling drum with respect to the fixed machine frame.

SUMMARY OF THE DISCLOSURE

In one aspect, the present disclosure describes a milling method. The milling method, which can be implemented in a milling machine such as a rotary mixer, can comprise: receiving, using a processor, signals from one or more sensors; determining, using the processor, whether a cutting height of a rotor of the milling machine is within a predetermined range of a target cutting height based on said receiving the signals from the one or more sensors; adjusting, using the processor, the cutting height of the rotor to the target cutting height responsive to receiving a control input at an operator control interface of the milling machine and when said determining determines that the cutting height of the rotor is outside the predetermined range of the target cutting height.

In another aspect, the present disclosure implements or provides a milling machine. The milling machine can comprise: an operator control interface; a frame having a plurality of legs; a rotor configured to process ground surface material; a mixing chamber, the rotor being provided at least partially in the mixing chamber; a plurality of sonic sensors; and a controller configured to automatically control height of the rotor to adjust a rotor cutting height for the rotor to a target cutting height stored in memory and accessible by the controller responsive to a control input received at the operator control interface and based on data from the plurality of sonic sensors.

In yet another aspect a milling system can be provided or implemented. The milling system can comprise: a rotor of a milling machine configured to process ground surface material and movable between a fully extended height and a fully retracted height; a plurality of sensors, each of the sensors being one of a sonic sensor or a camera; and a controller configured to automatically adjust a rotor cutting height of the rotor to a target cutting height responsive to a control input received at an operator control interface of the milling machine and based on continuously received data from the plurality of sensors indicating that the rotor cutting height has deviated from the target cutting height by a predetermined amount.

Other features and aspects of this disclosure will be apparent from the following description and the accompanying drawings.

DETAILED DESCRIPTION

The present disclosure relates to controlling rotor depth of a milling machine during a working operation thereof.

Figure 1:
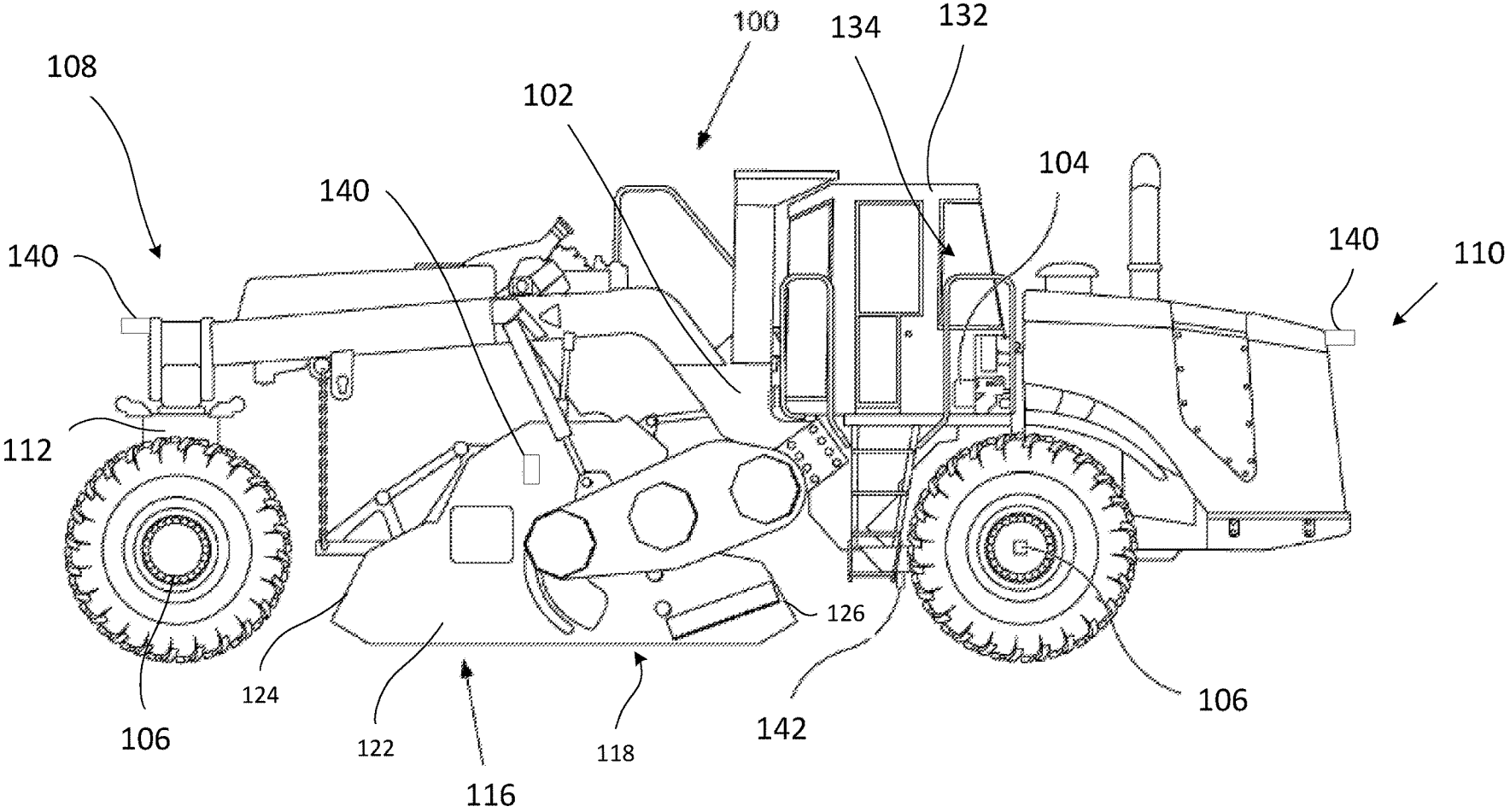
FIG. 1 is a side view of a milling machine according to one or more embodiments of the disclosed subject matter.
Figure 2:
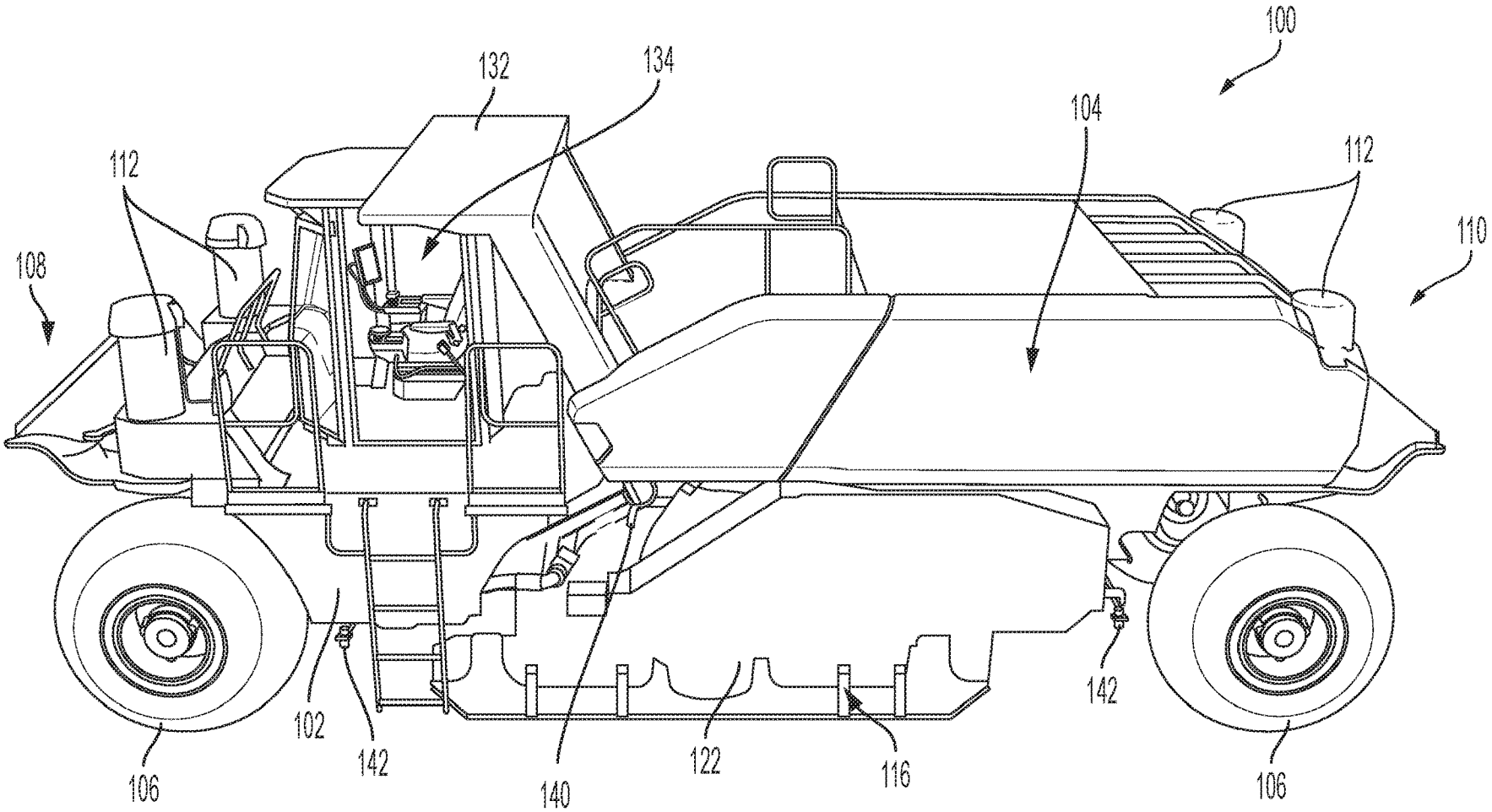
FIG. 2 is a side perspective view of another milling machine according to one or more embodiments of the disclosed subject matter.

Referring now to the drawings, FIG. 1 and FIG. 2 are a side and side perspective views, respectively, of a milling machine 100 and a milling machine 101 according to embodiments of the disclosed subject matter. Milling machine 100 and milling machine 101 are rotary mixers of fixed frame and adjustable frame type, respectively.

Generally, rotary mixers can be used to pulverize a ground surface, such as roadways based on asphalt, and mix a resulting pulverized layer with an underlying base, to stabilize the ground surface. Rotary mixers may also be used as a soil stabilizer to cut, mix, pulverize, and stabilize a soil surface, for instance, to attain a strengthened soil base. Optionally, rotary mixers may add asphalt emulsions or other binding agents during pulverization to create a reclaimed surface. Though the milling machine 100 and the milling machine 101 are shown as rotary mixers, other machines for road reclamation, soil stabilization, surface pulverization, or other applications may be implemented according to embodiments of the disclosed subject matter, such as cold planers.

Each of the milling machine 100 and the milling machine 101 can include a frame 102, an engine 104 supported on the frame 102, and one or more ground engaging units or traction devices 106. The traction devices 106 can be operatively coupled to the engine 104 by a transmission mechanism (not shown) to drive the traction devices 106 and propel the milling machine 100 and the milling machine 101. Although, the traction devices 106 are shown as wheels (with tires), the traction devices 106 may alternatively be tracks, or a combination of both tracks and wheels, according to embodiments of the disclosed subject matter.

The frame 102 can include a front portion 108 and a rear portion 110. Generally, the legs 112 can couple the traction devices 106 to the frame 102. Legs 112 may be provided at one or more of the front portion 108 and the rear portion 110. Each of the legs 112 for milling machine 100 may be fixed, meaning that a height thereof cannot be adjusted, whereas height of some or all of the legs 112 of the milling machine 101 may be adjusted. Hence, the legs 112 of the milling machine 101 may be referred to as adjustable columns. Though height of legs 112 of milling machine 101 can be adjustable, according to one or more embodiments such legs 112 can be operated according to a "fixed frame mode," where the frame height 102 is fixed during rotor depth adjustment.

In the case of adjustable legs 112 of the milling machine 101, the legs 112 can be controlled to allow adjustment of a height, a grade, and/or a slope of the frame 102 relative to a ground surface, for instance. That is, the legs 112 can be moved up or down, independently or together (e.g., in pairs or all together), to adjust the height, the grade, and/or the slope of the frame 102. Accordingly, the frame 102 can be adjusted relative to the ground surface. In an embodiment, the legs 112 may be actuated hydraulically, for instance, via respective vertical actuators in the legs 112. Optionally, each leg 112 can include a sensor to sense or detect position (and hence height) thereof.

The milling machines 100, 101 can also be comprised of a milling or mixing chamber 116. Optionally, the mixing chamber 116 may be considered part of the frame 102, since the mixing chamber 116 and the frame 102 may not be adjusted in the case of fixed frame milling machine 100 and since the mixing chamber 116 and the frame 102 can be adjusted together based on the up/down movement of the legs 112 in the case of adjustable-frame milling machine 100.

The mixing chamber 116 can be located proximate to or at a center portion of the milling machines 100, 101, such as shown in FIG. 1 and FIG. 2. As shown in FIGS. 1-8, the mixing chamber 116 can have a pair of opposing side plates 122, a front door 124, and a rear door 126. During a working operation (e.g., cutting, milling, mixing) the milling machine 100, 101 can processes material and the side plates 122 may expand and contract and may be viewed as flowing on and within the material. A rotor 118 can be provided in the mixing chamber 116, either partially or fully depending upon a mode or operation of the milling machine 100, 101.

Figure 8:
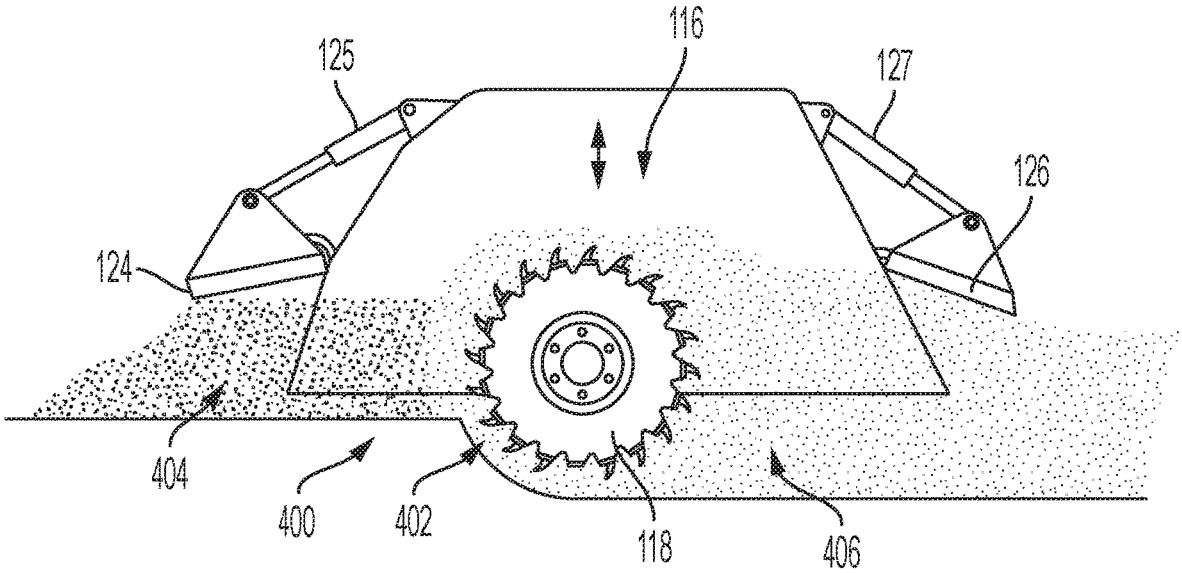
FIG. 8 shows an example of the mixing chamber of FIG. 6 in a second state of operation of the milling machine according to one or more embodiments of the disclosed subject matter.

The rotor 118 can be controlled to rotate so as to break and pulverize a surface layer 400 of the ground surface, such as diagrammatically shown in FIG. 8. Optionally, feed material 404 can be provided for mixing with the pulverized surface layer 400. Optionally, the feed material 404 may be an asphalt layer provided over a base layer in the form of the surface layer 400. The rotor 118 may also be moved vertically (i.e., up and down) within the mixing chamber 116 via one or more actuators (not expressly shown) between a fully extended position and a fully retracted position. The rotor 118 can be moved vertically independently of the movement of the legs 112. That is, according to embodiments of the disclosed subject matter, the rotor 118 can be controlled to move vertically without moving any, all, or some of the legs 112, some or all of the legs 112 can be controlled to move without vertical movement of the rotor 118, or the rotor 118 can move vertically along with movement of some or all of the legs 112. Indeed, as noted above for milling machine 100, the legs 112 of the rotor may not be capable of being moved vertically.

Figure 7:
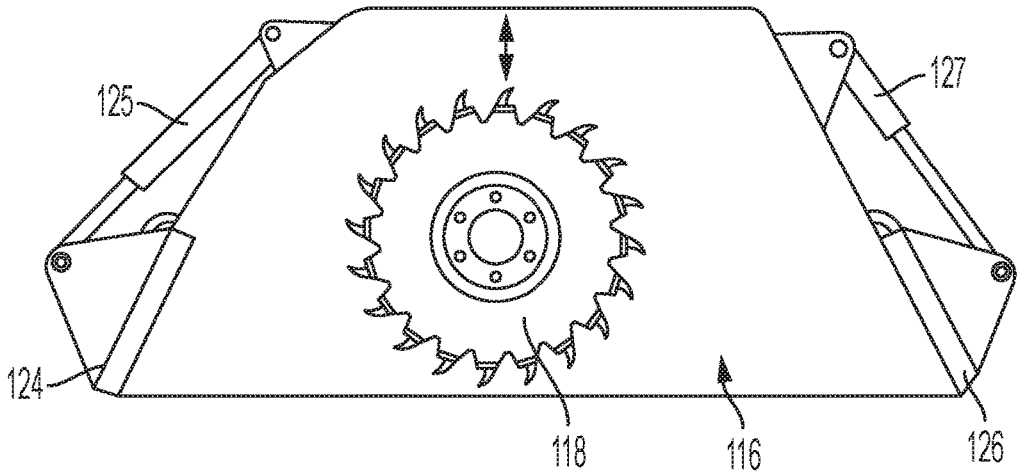
FIG. 7 shows an example of a mixing chamber of a milling machine in a first state of operation of the milling machine according to one or more embodiments of the disclosed subject matter.

FIG. 7 may be representative of the rotor 118 in the fully retracted position, and FIG. 8 may be representative of the rotor 118 in the fully extended position. Optionally, the fully retracted position may be called or characterized as a travel or stow position, and the fully extended position may be called or characterized as a working position (or cutting or mixing or milling position). Thus, FIG. 8 may also be representative of the rotor 118 in the cutting position, though the cutting position is not necessarily always at the fully extended position. In the cutting position the rotor 118 can extend below the surface layer 400 to cut the surface layer 400 according to a predetermined cutting depth. As noted above, the rotor 118 may also process (e.g., cut, mix) feed material 404, such as asphalt, with the pulverized surface layer 400.

A sensor may be provided in association with the rotor 118 or a portion thereof (e.g., in a cylinder of each of one or more actuators thereof) to determine vertical positioning or height of the rotor 118. Such vertical positioning or height of the rotor 118 may be relative to a characteristic of the milling machine 100, such as an amount by which the rotor 118 projects from the bottom of the mixing chamber 116. Such vertical positioning or height of the rotor 118 may also be relative to the ground surface, for instance, the surface layer 400 of the ground surface and optionally the amount of feed material 404.

The front door 124 can be located at a front end of the mixing chamber 116, and the rear door 126 can be positioned at a rear end of the mixing chamber 116. An actuator 125 can be operatively coupled to the first door 124 to open and close the front door 124. The actuator 125 can be controlled to set the front door 124 in a locked state or a floating state. Likewise, an actuator 127 can be operatively coupled to the rear door 126 to open and close the rear door 126. The actuator 127 can be controlled to set the rear door 126 in a locked state or a floating state.

The front door 124, when open, can allow entry of feed material 404 into the mixing chamber 116 (in a case that the milling machine 100, 101 is moving forward). Positioning of the front door 124 can affect a degree of pulverization and/or mixing by regulating an amount, direction, and speed of a material flow of the feed material 404 into the mixing chamber 116. The rear door 126, whether open in the locked state or the floating state (also in the case that the milling machine 100, 101 is moving forward), can allow exit of pulverized and/or mixed resultant material 406 to form a pulverized surface. The positioning of the rear door 126 can affect the degree of pulverization and/or compactness by regulating the amount and direction of the material flow through the mixing chamber 116.

An operator control station 132 can also be supported on the frame 102. The operator control station 132 can include a variety of components and controls to operate the milling machine 100, 101, generally referred to in FIG. 1 and FIG.

2 as an operator control interface 134. The operator control interface 134 can include a steering system (e.g., a steering wheel, joystick, lever, etc.), a transmission control system, a speed control system for the milling machine 100, 101, one or more displays, and a milling control interface. The milling control interface can have an operator control button, a toggle switch, a touch panel (e.g., of the one or more displays), a rotary switch, a radial dial, a switch, etc.

The operator control interface 134 can receive inputs from an operator of the milling machine 100, 101 to control various operations of the milling machine 100, 101. Such operations can include controlling a speed of the milling machine 100, 101, a direction of the milling machine 100, 101 (i.e., forward or backwards), and milling-related operations, such as a return to cut operation, a working operation (e.g., cutting, mixing, milling, etc.), and an exit cut operation. The operator control interface 134, for instance, the milling control interface thereof, can also be used to receive settings from the operator, for instance, for the milling-related operations such as those discussed above. For instance, the operator control interface 134 can receive inputs to control or set engine speed, rotor speed, rotor height of the rotor 118 (via at least vertical movement of the rotor 118), front door 124 and/or rear door 126 positioning and state, rotor raise or lower speed of the rotor 118, raise or lower speed of the frame 102, etc. as non-limiting examples of settings for milling-related operations. In the case of milling machine 101, the operator control interface 134 can also receive inputs to control height of the frame 102, which may also control height of the rotor 118.

The operator control interface 134 can also receive an input from the operator to capture and save (discussed in more detail below) current settings for a milling-related operation, such as current cutting settings, for later retrieval so the milling machine 100, 101 can be set to the same settings as before or perform an operation in the same way as before. Optionally, the operator control interface 134 can receive a single input from the operator to capture and save the current settings. Such settings, optionally, may be provided (e.g., displayed) to the operator and selectable, via the operator control interface 134, as a list of "favorites" in association with particular milling-related operations.

As shown in FIGS. 2-6, the milling machine 101 can also include a plurality of sensors (though one or more embodiments may include only one, some or more than the sensors shown). Likewise, though not all expressly shown in FIG. 1, the milling machine 100 can also include a plurality of sensors arranged in like or substantially like fashion as the case may be for a fixed-frame milling machine. One or more of the sensors can be in the form of image sensors (e.g., cameras) 140. Additionally or alternatively, one or more sensors can be in the form of sonic sensors 142. The milling machine 101 of FIGS. 2-6, for instance, shows a combination of multiple image sensors 140 and multiple sonic sensors 142. Optionally, sensors in the form of lasers can be provided or substituted, for instance, for some or all of the sonic sensors 142.

Figure 3:
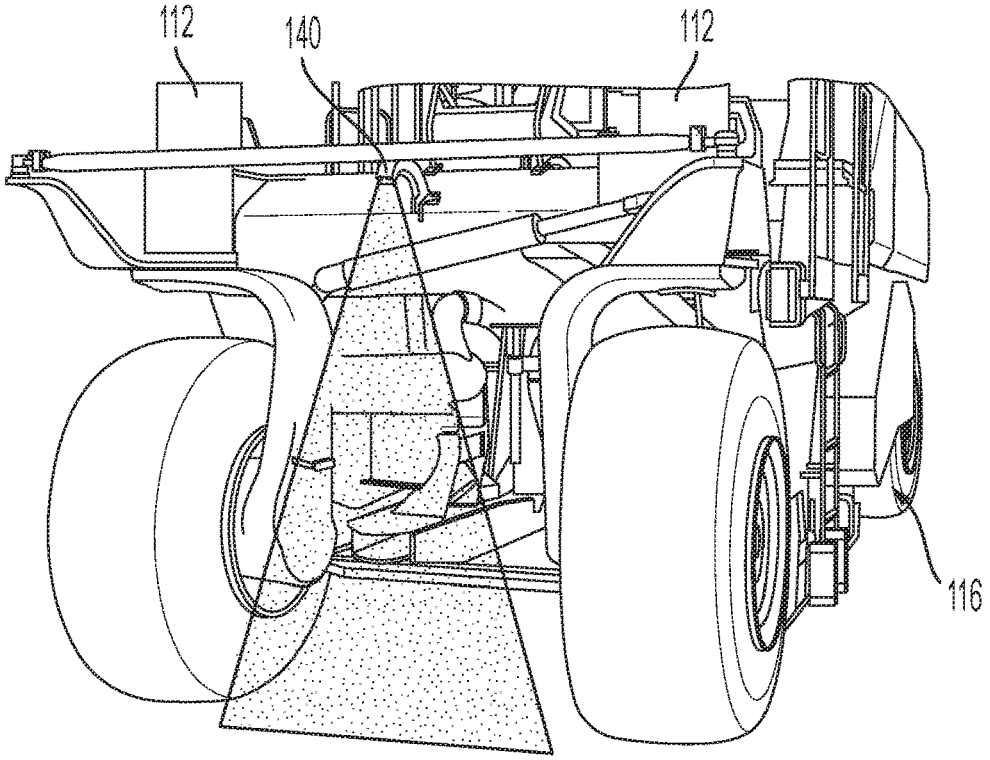
FIG. 3 is a front view of a portion of the milling machine of FIG. 1.
Figure 4:
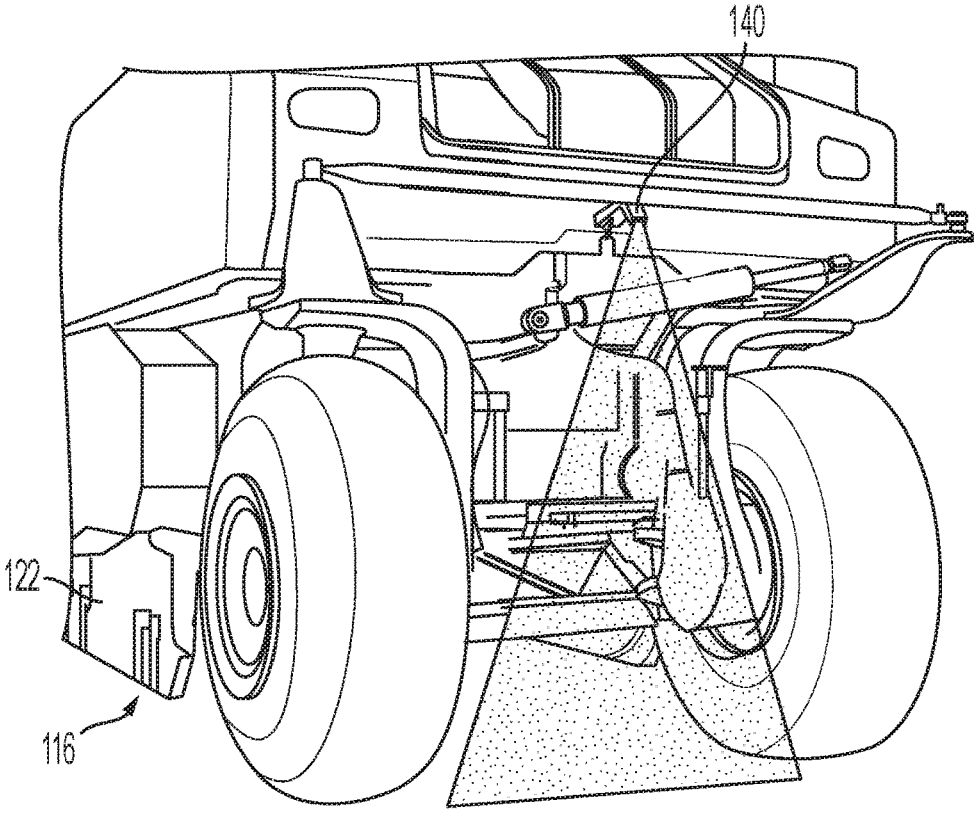
FIG. 4 is a rear view of a portion of the milling machine of FIG. 1.
Figure 5:
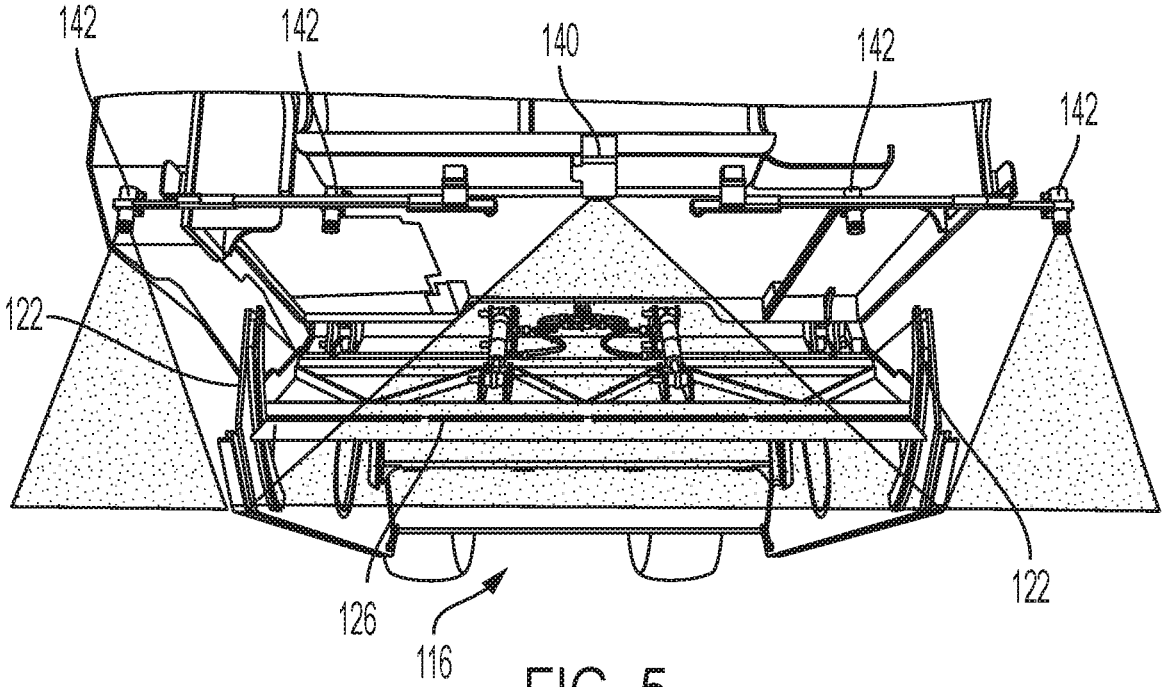
FIG. 5 is a rear view of a mixing chamber of the milling machine of FIG. 1.
Figure 6:
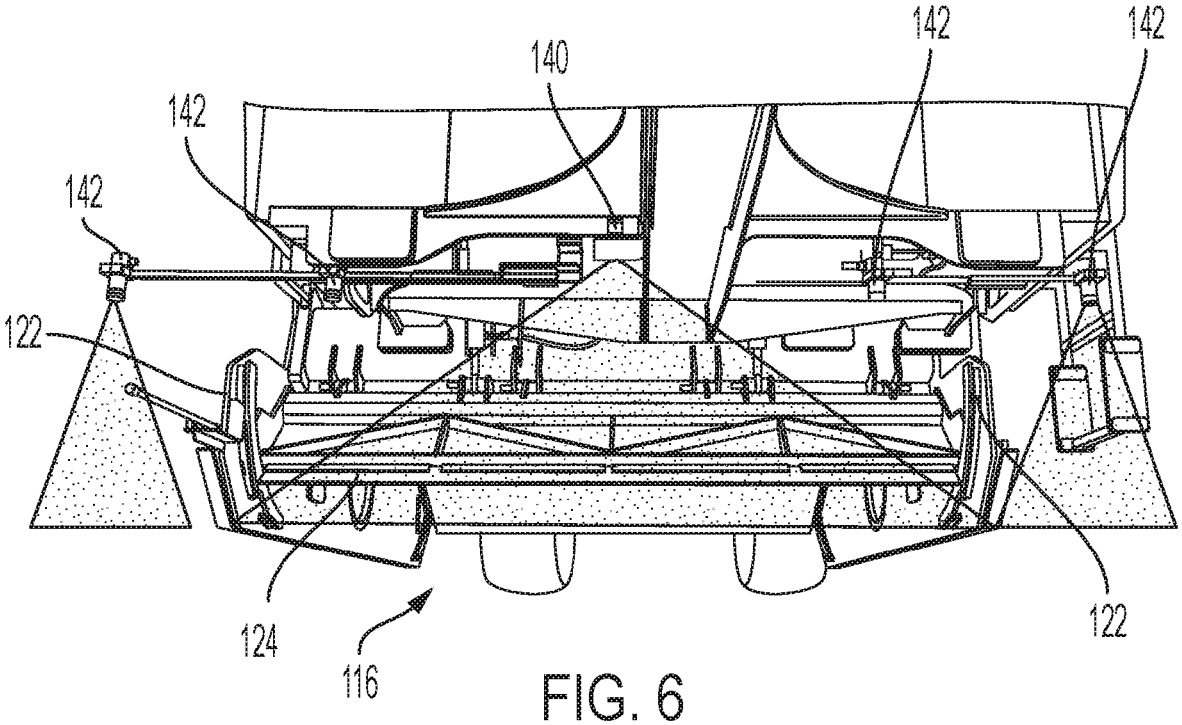
FIG. 6 is a front view of the mixing chamber of the milling machine of FIG. 1.

As a non-limiting example, the milling machine 101 can have, at one or more sides thereof, a side image sensor 140, such as shown in FIG. 2 (note that the side image sensor 140 may alternatively be provided on the other side of the milling machine 101, or side image sensors 140 may be provided on each side of the milling machine 101); a front image sensor 140, such as shown in FIG. 3; a rear image sensor 140, such as shown in FIG. 4; an image sensor 140 provided at a rear side of the mixing chamber 116, such as shown in FIG. 5; and an image sensor 140 provided at the front side of the mixing chamber 116, such as shown in FIG. 6. Each of the image sensors 140 can be configured to capture images, for instance, images corresponding to the ground surface (e.g., a top surface thereof) and/or images corresponding to portions of the milling machine 101. The images can be processed to determine various heights of the milling machine 100, 101, such as height of the frame 102, height of a bottom of the mixing chamber 116, state or position of the front door 124 and/or the rear door 126, height of the rotor 118, and/or working depth of the rotor 118, which can be used to control such components according to selected settings for the milling machine 100, 101.

For instance, the side image sensor 140 of FIG. 1 and FIG. 2 can capture images of the bottom of the side plate 122 and the ground surface, where such images can be processed to determine height of the bottom of the mixing chamber 116 relative to the ground surface. As noted above, the mixing chamber 116 may be considered part of the frame 102. Hence, the distance from the bottom of one or more of the side plates 122 to the ground surface may be characterized as a height (or heights) of the frame 102. According to embodiments of the disclosed subject matter, the side image sensor 140 can capture images to determine height of the front of the side plate 122 at the front of the mixing chamber 116 relative to height of the rear of the side plate 122 at the rear of the mixing chamber 116.

As another example, the image sensors 140 respectively provided at the front and rear sides of the mixing chamber 116 can capture images of the front door 124 and the rear door 126, where such images can be processed to determine or control states of the front door 124 and the rear door 126. Such image sensors 140 may also capture images of or inside the mixing chamber 116 (depending upon the state and configuration of the front door 124 and the rear door 126). Such images can be processed to determine the distance of the bottom of the mixing chamber 116 and/or the rotor 118 relative to the ground surface and characteristics of the ground surface, such as the surface layer 400 and/or the resultant material 406.

As yet another example, the front image sensor 140 and the rear image sensor 140 can capture images of the ground surface at the front portion 108 and the rear portion 110 of the frame 102, respectively, and optionally portions of the milling machine 100, 101 at the front portion 108 and the rear portion 110. Such images can be processed to determine height (or heights) of the frame 102 relative to the ground surface.

The milling machine 100, 101 can have, as a non-limiting example, a plurality of sonic sensors 142 at the rear side of the mixing chamber 116, such as shown in FIG. 5 (for milling machine 101), and a plurality of sonic sensors 142 at the front side of the mixing chamber 116, such as shown in FIG. 6 (for milling machine 101). More or less than the number of sonic sensors 142 shown in FIG. 5 and FIG. 6 can be implemented, however. Such sonic sensors 142, which can be provided on the frame 102, can sense distance to the ground surface. Hence, data from the sonic sensors 142 can be processed to determine a height of the frame 102 (or heights of different portions of the frame) relative to the ground surface. In the case of adjustable-frame milling machine 101, such data may be used without the need to provide position sensors in the legs 112 or without having to process data from position sensors in the legs 112 in combination with the data from the sonic sensors 142 to determine height-related information for various portions of the frame 102.

According to one or more embodiments, one of the sonic sensors 142 at the left side of the milling machine 100, 101 can determine height of the left side of the frame 102, one of the sonic sensors 142 at the right side of the milling machine 100, 101 can determine height of the right side of the frame 102, and one or more sonic sensors 142 inward of the left and right sides of the milling machine 100, 101 can determine height of a middle portion (or portions) of the frame 102. Optionally, the data from the sonic sensors 142 may be used to determine an average height of the frame 102.

Figure 9:
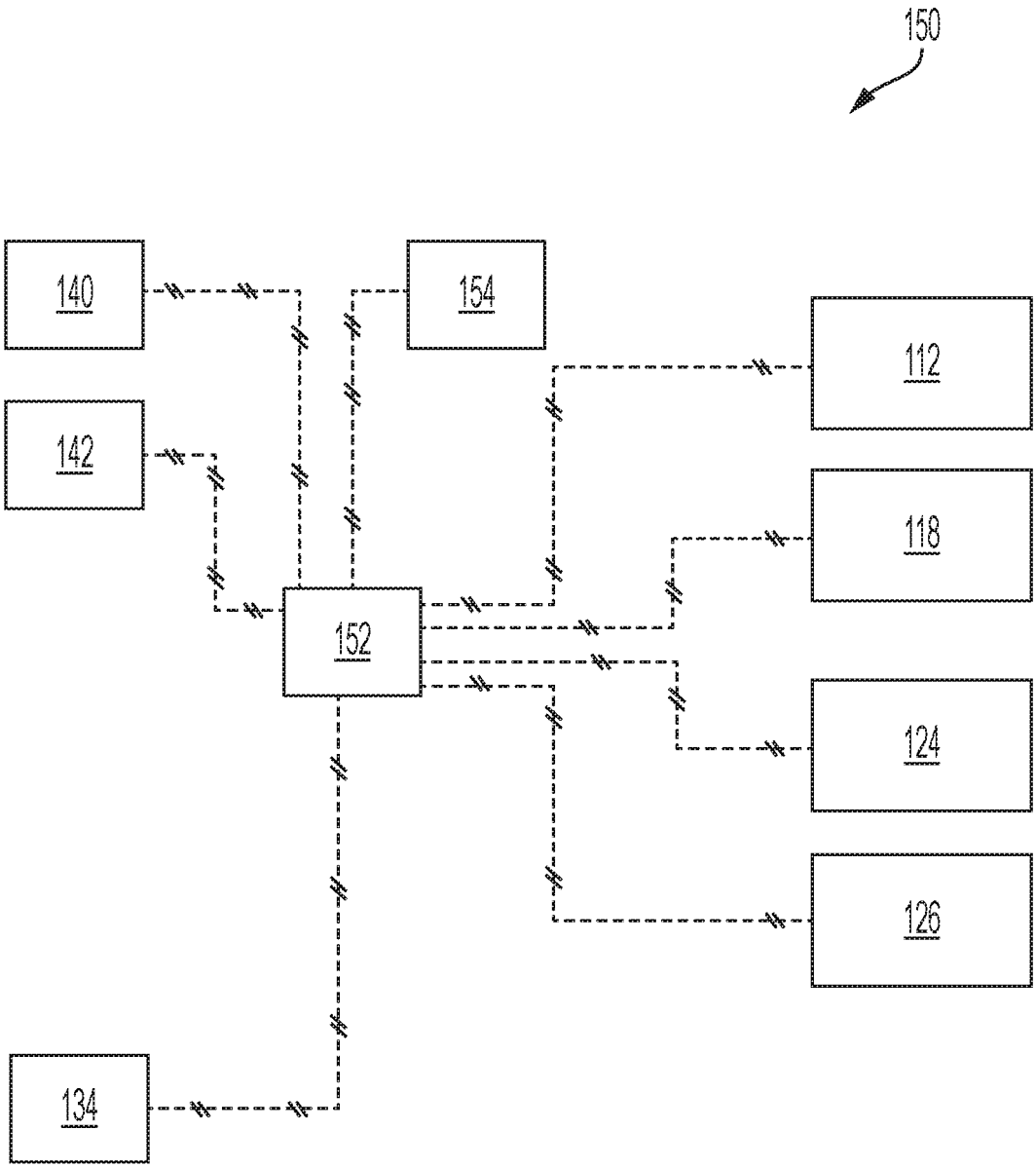
FIG. 9 illustrates a control system according to one or more embodiments of the disclosed subject matter.

FIG. 9 illustrates a control system 150 according to one or more embodiments of the disclosed subject matter. The control system 150 can be implemented on the milling machine 100, 101 to control operation of the milling machine 100, 101.

The control system 150 can include a controller or control circuitry 152, which may be or include a microprocessor or other processor or processing device configured to control a plurality of devices or systems of the milling machine 100, 101. For example, in an embodiment the controller 152 may be an electronic control module (ECM) or multiple ECMs.

The controller 152 can be in communication with various components of the milling machine 100, 101. For instance, FIG. 9 shows that the controller 152 can send control signals to control the rotor 118, the front door 124 of the mixing chamber 116, and the rear door 126 of the mixing chamber 116. In the case of milling machine 101, the controller 152 can send control signals to control the legs 112. Thus, in the case of fixed-frame milling machine 100 the controller 152 may not send control signals to the legs 112.

Depending upon whether respective actuators of the foregoing components have their own position sensors or the like, the controller 152 can also receive signals from the foregoing components. Additionally or alternatively, the controller 152 can receive signals from the image sensor(s) 140 and the sonic sensor(s) 142. Such feedback from the image sensor(s) 140 and the sonic sensor(s) 142 can be used to control the rotor 118, the front door 124 of the mixing chamber 116, and the rear door 126 of the mixing chamber 116. And, in the case of adjustable-frame milling machine 101, the controller 152 can send control signals to control the legs 112.

The controller 152 can also receive signals from the operator control interface 134. Such signals can correspond to operator control inputs to control the milling machine 100, 101, to input settings for control of the milling machine 100, 101, and to capture and record current settings of the milling machine 100, 101 during milling-related operations, such as a working operation, a return to cut operation, and an exit cut operation. For instance, the controller 152 can receive control signals from the operator control interface 134 in response to one or more operator control inputs to the operator control interface 134 to perform reset a working operation, a return to cut operation, or an exit cut operation. Optionally, each of the operations can be initiated and performed via a predetermined number of operator control inputs to the operator control interface 134. For instance, embodiments of the disclosed subject matter can implement a single operator control input to the operator control interface 134 (e.g. the operator only has to activate one button, lever, etc.) to perform either the particular operation. As another example, multiple operator control inputs (e.g., two) to the operator control interface 134 can be implemented for each of the operations, for instance, to initiate different phases of the particular operation.

Memory 154 may be provided, and may be accessed by the controller 152. Though memory 154 is shown in FIG. 9 as separate from the controller 152, according to one or more embodiments some or all of the memory 154 can be implemented within the controller 152. The memory 154 may include one or more storage devices configured to store information used by the controller 152 to perform operations to control the milling machine 100, 101. For instance, memory 154 can store one or more operating programs for the controller 152. Thus, the memory 154, or portions thereof, may be characterized as a non-transitory computer-readable storage medium that stores computer-readable instructions which, when executed by a computer (e.g., a microprocessor of the controller 152), can cause the computer to control operations to control the milling machine 100, 101, such as to perform the return to cut operation, the cutting operation, or the exit cut operation.

Optionally, the memory 154 can store settings for the milling machine 100, 101, for instance, settings to configure components of the milling machine 100, 101, such as the rotor 118, the front door 124, and/or the rear door 126, and heights of the legs 112 in the case of milling machine 101, to perform particular operations, such as the working operation, the return to cut operation and/or the exit cut operation. Such settings may be entered (i.e., set) by the operator using the operator control interface 134, as noted above.

INDUSTRIAL APPLICABILITY

As noted above, the present disclosure relates to controlling rotor depth of a milling machine, such as milling machine 100, 101, during a working operation thereof.

Depth of a rotor, such as rotor 118, may deviate from a target depth due to changes during the working operation, such as changes in ground profile, changes in material conditions, or various interactions between the milling machine and the ground surface. According to one or more embodiments of the disclosed subject matter, height of the rotor 118 and/or the frame 102 can be controlled to maintain or return to a predetermined target working depth for the rotor 118. Such control can be with respect to an overall working depth of the rotor 118, such as an average working depth, or with respect to working depths associated with the left, right, and center of the rotor 118. Generally, the control can be automatic, responsive to a control input at the operator control interface 134, based on a predetermined time period, and/or when the controller 152 determines that the working depth of the rotor 118 has deviated by a predetermined amount based on data received from one or more sensors of the milling machine 100, 101, such as one or more of the sensors 140 and/or one or more of the sensors 142. In the case of an adjustable-frame milling machine, such as milling machine 101, data from the sensors 140 and/or the sensors 142 may not have to be reconciled with data from position sensors in the legs 112.

Figure 10:
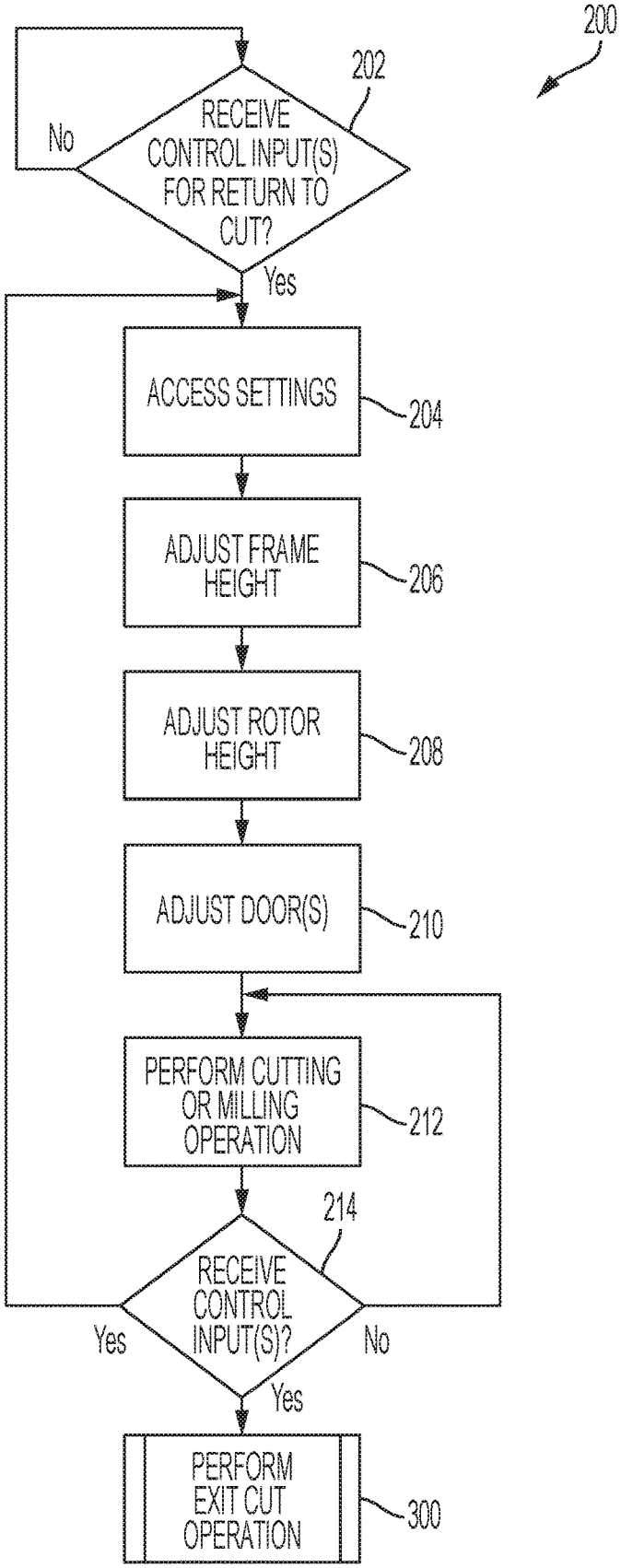
FIG. 10 is a flow chart of a method for a return to cut operation according to one or more embodiments of the disclosed subject matter.

FIG. 10 is a flow chart of a method 200 for a return to cut operation according to one or more embodiments of the disclosed subject matter. As noted above, the controller 152 can control at least the rotor 116, the front door 124, and the rear door 126 to perform the return to cut operation (and the legs 112 in the case of an adjustable-frame milling machine, such as milling machine 101). Moreover, settings for the return to cut operation, which may have been previously input by the operator using the operator control interface 134 and saved in the memory 154, can be accessed by the controller 152 to control the return to cut operation. Feedback data from one or more sensors, such as one or more of image sensors 140 and/or one or more of sonic sensors 142, can be used to control the height of the rotor 116 and the positioning of the front door 124 and the rear door 126 (and the height(s) of the legs 112 in the case of milling machine 101) to achieve the settings for the return to cut operation.

At operation 202 the method 200 can involve determining whether a control input (or inputs) has been received to perform the return to cut operation. Such control input can be received at the operator control interface 134, and the controller 152 can monitor whether a control signal corresponding to the control input is received. The control input to initiate the return to cut operation at operation 202 can be received at the beginning of a cutting pass of the milling machine 100. Additionally or alternatively, the control input to initiate the return to cut operation can be received during (e.g., in the middle of) the cutting pass of the milling machine 100.

If the control input to perform the return to cut operation is received, control can proceed to operation 204. At operation 204 the method 200 can access settings for the milling machine 100, 101 to perform the return to cut operation. As noted above, such settings can be stored in the memory 154 and accessed by the controller 152. The settings may correspond to cutting settings for an immediately previous cutting operation of the milling machine 100, 101, which may have been automatically captured and saved by the operation upon an input to the operator control interface 134. Optionally, the previous cutting operation may be part of the same cutting pass. Alternatively, the previous cutting operation can be from a previous cutting pass, where the settings for the previous cutting operation can be used for a next or subsequent cutting pass. To be clear, the settings may include results- or target-based settings, such as a particular cutting depth, and, consequently, settings for specific components of the milling machine 100, 101 to achieve the particular results- or target-based setting(s).

At operation 206 the height of the frame 102 may be adjusted if the milling machine is an adjustable-frame milling machine, such as milling machine 101. For example, the height of the frame 102 can be lowered by controlling one or more of the legs 112, such as all of the legs 112. Such adjustment can be relative to the ground surface, and can be to a cutting height for the milling machine 101. The height adjustment of the legs 112 can also adjust the height of the mixing chamber 116, since the mixing chamber 116 may be considered part of the frame 102 and not independently movable relative to the frame 102. Such height adjustment of the legs 112 can also adjust (e.g., lower) the height of the rotor 118. Of course, in the case of a fixed-frame milling machine, such as milling machine 100, the height of the frame 102 may not be adjusted.

The height adjustment of the frame 102 can be based on signals from one or more of the image sensors 140 and/or one or more of the sonic sensors 142. For instance, data from the image sensor(s) 140 and/or the sonic sensor(s) 142 can be processed to determine height of the frame 102 relative to the ground surface and/or height of the mixing chamber 116 relative to the ground surface. Optionally, position sensors of the legs 112 themselves may be used to adjust the height of the frame 102, though, as noted above, processing of the data from the image sensor(s) 140 and/or the sonic sensor(s) 142 to determine height of the frame 102 and/or mixing chamber 116 can be performed separately from data from the position sensors of the legs 112. The processing can also involve determining when the height of the frame 102 and/or the height of the mixing chamber 116 has reached the height(s) from operation 204. That is, when the controller 152 determines, based on the feedback from the sensors, that the height of the frame 102 has been adjusted to the desired setting, the controller 152 can stop adjusting the height of the frame 102 and maintain the height of the frame 102 at the desired setting.

According to one or more embodiments, the height of the frame 102, particularly the height of the mixing chamber 116, can be, according to the settings from the operation 204, set for a desired (e.g., optimal) height for the cutting operation (or some other working operation, as the case may be). In general, a desired height for the mixing chamber 116 can be the bottom of the mixing chamber 116, for instance, the bottom of the side plates 122, being above the top of the surface layer 400 and at or about at half the height of the resultant material 406. Such height of the bottom of the mixing chamber 116 can be set such that the bottom of the mixing chamber 116 on one hand does not end up digging into the surface layer 400 and on the other hand does not leave sufficient gapping below the mixing chamber 116 where an undesirable amount of material can escape the mixing chamber 116 (e.g., any or enough to make the mixing operation unsatisfactory).

At operation 208 the height of the rotor 118 can be adjusted. For example, the height of the rotor 118 can be lowered by controlling one or more actuators thereof (not expressly shown) operatively coupled to the rotor 118. Such adjustment can be relative to the ground surface, and can be according to a cutting height for the rotor 118 from operation 204, such as shown in FIG. 8. Optionally, different portions of the rotor 118 can be adjusted to different heights. For instance, the left side, the right side, and the middle of the rotor 118 may be adjusted to respective heights, which may be different or the same.

The height of the rotor 118 can be adjusted independent of the adjustment of the height of the frame 102. Additionally, though operation 208 is shown in FIG. 10 after operation 206, operation 208 can be performed prior to operation 206 or at the same time as operation 206 (if operation 206 is performed). According to embodiments of the disclosed subject matter, the height of the rotor 118 and/or the height of the frame 102 can be adjusted to optimal heights for a particular cutting operation.

The adjustment of the height of the rotor 118 can be based on signals from one or more position sensors associated with the rotor 118, such as position sensor(s) of the corresponding one or more actuators. Optionally, the adjustment of the rotor 118 can be based on data from one or more of the image sensors 140 and/or one or more of the sonic sensors 142. For instance, according to one or more embodiments, the height of the rotor 118 can be adjusted based on the height of the frame 102 or the mixing chamber 116, whether naturally occurring based on characteristics of the ground surface and/or set via adjustment of the legs 112. Based on the feedback from the sensors the controller 152 can control the height adjustment of the rotor 118 to achieve the desired setting (or settings). That is, when the controller 152 determines, based on the feedback from the sensors, that the height of the rotor 118 has been adjusted to the desired setting, the controller 152 can stop adjusting the height of the rotor 118 and maintain the height of the rotor 118 at the desired setting(s).

At operation 210 the front door 124 and/or the rear door 126 can be adjusted. For instance, each of the front door 124 and the rear door 126 can be controlled to a front door cutting position and a rear door cutting position, respectively, for a cutting operation of the milling machine 100, 101. Such control can include opening the front door 124 and/or the rear door 126, for instance, from a fully closed position. Each of the front door 124 and the rear door 126 can be at least partially open in the respective cutting positions. The amount at which the front door 124 and the rear door 126 are open can be the same or different. Optionally, the positioning of the front door 124 and/or the rear door 126 can be set in combination with the height of the mixing chamber 116, for instance, for a particular cutting operation (e.g., optimum cutting height). Though operation 210 is shown in FIG. 10 after operation 208, operation 210 can be performed prior to operation 206, prior to operation 208, or at the same time as one or more of operation 206 or operation 208 (again, assuming operation 206 is performed).

Operation 210 can also include setting the front door 124 to a locked state whereby the front door 124 is set and does not open or close during the cutting operation. Optionally, the front door 124 may be prevented from being set to a floating state, particularly where the milling machine 100, 101 is moving forward during the cutting operation. The amount by which the front door 124 is open can be to allow for a predetermined amount of feed material 404 to enter the mixing chamber 116.

Operation 210 can also include setting the rear door 126 to the locked state or the floating state. In the floating state the rear door 126 can provide a down pressure on the resultant material 406. The amount of down pressure can be according to the settings of operation 204.

An amount of gradation may be determined based on how long resultant material 406 is retained in the mixing chamber 116, where increased gradation may correspond to keeping the resultant material 406 in the mixing chamber 116 for a relatively longer amount of time and decreased gradation may correspond to keeping the resultant material 406 in the mixing chamber 116 for a relatively shorter amount of time. Thus, an amount by which the rear door 126 is open, either in the locked state or the floating state, can determine the amount of gradation of the resultant material 406. The amount of down pressure provided by the rear door 126 (via control of the actuator 127, for instance, and/or supplemental hydraulics) can also control the amount by which the rear door 126 is allowed to open. In the floating state the rear door 126 can be controlled to float down on top of the resultant material 406 and, depending upon the set amount of down pressure and hence the "heaviness" of the floating rear door 126, can be set to a maximum value that the resultant material 406 lets the rear door 126 float to keep the resultant material 406 in the mixing changer 116 to achieve a desired result. As a non-limiting example, for 50% of down pressure for the rear door 126 in the floating state and a relatively deep cutting depth the rear door 126 may float to 100% open, whereas for a relatively shallow cutting depth the rear door 126 may float to only 15-20% open.

The adjustment of the front door 124 and/or the rear door 126 can be based on signals from one or more of the image sensors 140 and/or one or more of the sonic sensors 142. For instance, data from the image sensor(s) 140 and/or the sonic sensor(s) 142, particularly those at the front and rear of the mixing chamber 116, can be processed by the controller 152, for instance, to determine positioning of the front door 124 and/or the rear door 126 (e.g., open, closed, amount open, moving, distance from ground surface, etc.). The processing can also involve determining when the front door 124 and/or the rear door 126 have reached the desired state according to the settings of operation 204 and based on feedback from the sensors.

Upon determination that all of the settings for the return to cut operation have been achieved, either based on timing and/or data from various sensors, such as the image sensor(s) 140 and/or the sonic sensor(s) 142 as discussed above, at operation 212 the milling machine 100 can perform a working operation, such as a cutting operation, according to the settings of operation 204. Optionally, various settings of the cutting operation can be changed during the cutting operation, based on changing cutting conditions, such as changes in the condition of the ground surface (e.g., hard or wet) or a desired cutting operation outcome. The operator may choose to save the updated settings for the cutting operation by providing input to the operator control interface 134.

Figure 11:
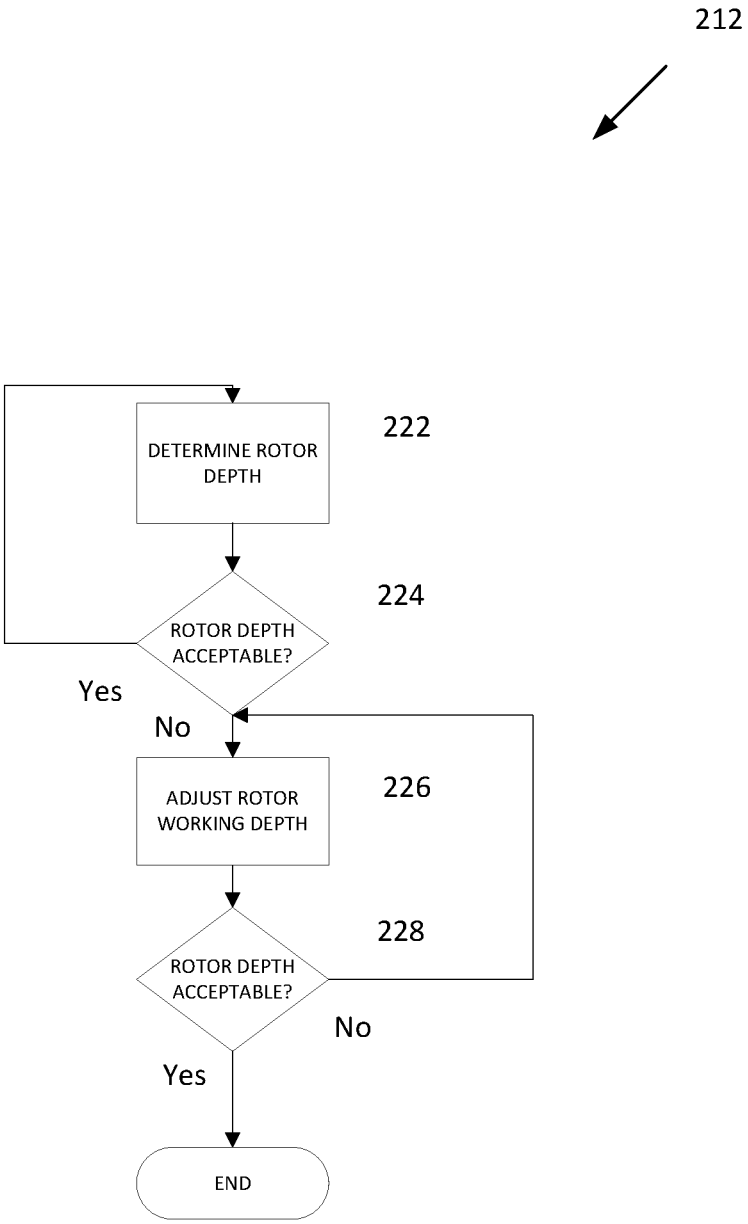
FIG. 11 is a flow chart of a method for a working operation according to one or more embodiments of the disclosed subject matter.

FIG. 11 is a flow chart of a method for performing the working operation 212. Generally, the working operation 212 can be performed based on the settings of operation 204 in FIG. 10.

At operation 222 the working depth of the rotor 118 can determined. Such determination may be made automatically or manually based on data from one or more of the image sensor(s) 140 and/or the sonic sensor(s) 142. For instance, an operator may view images of the interface of the rotor 118 and the working surface from one or more of the image sensor(s) 140 and determine, visually (e.g., via one or more displays of the operator control interface 134), the working depth of the rotor 118. Additionally or alternatively, data from the images can be processed using the controller 152 to determine the working depth of the rotor 118. Working depth of the rotor 118 may be determined based on surface data captured from one or more of the sonic sensors 142. For instance, working depth of the rotor may be inferred from data from one or more sonic sensors 142 at the rear of the mixing chamber 116 based on characteristics of the resultant material 406.

Optionally, according to one or more embodiments, the determining of the working depth of the rotor for operation 222 can be with respect to individual portions of the working depth of the rotor 118. For instance, the determining can be made with respect to a left portion of the rotor 118, a right portion of the rotor 118, and/or a center portion of the rotor 118 between the left and right portions, wherein data associated with each of the portions can be captured by corresponding one or more image sensor(s) 140. According to one or more embodiments, the data from the different portions of the rotor 118 can be used to determine an average working depth of the rotor 118. Likewise, working depth of the rotor 118 may be determined based on surface data captured from one or more of the sonic sensors 142, such as based on characteristics of the resultant material 406.

Operation 224, which can be performed continuously or periodically, can assess whether the determined working depth of the rotor 118 is acceptable. Acceptable can mean whether the working depth of the rotor 118 is at or within a predetermined amount of a target working depth (e.g., a target working depth range), for instance, as set in operation 204. Additionally or alternatively, acceptable can mean whether the working depth of the rotor 118 has deviated from the target working depth or the target working depth range for a predetermined amount of time and/or distance of travel of the working machine 100, 101. Optionally, acceptable can mean that the working depth of the rotor 118 is estimated or predicted to deviate from the target working depth or from the predetermined amount of the target working depth.

According to one or more embodiments, such determination can be done visually by the operator via images on one or more displays of the operator control interface 134, for instance, generated from images captured by the one or more image sensor(s) 140. Additionally or alternatively, such determination may made by processing data from the one or more image sensor(s) 140 by the controller 152. Such processing can include comparing the determined working depth of the rotor 118 to a predetermined target depth or target depth range using the controller 152. The predetermined target depth or target depth range may be stored in the memory 154, for instance, along with one or more other predetermined target depth or target depth ranges correlated to characteristics of working operations, such as travel speed of the machine 100, rotation speed of the rotor 118, height of the frame 102 (e.g., bottom of the side plates 122), etc. As alluded to above, such processing may also include comparing an amount of time and/or distance traveled with the working depth of the rotor 118 deviated from the target depth or outside of the target depth range using the controller 152. In this regard, data from one or more of the image sensor(s) 140 can be used to determine distance travelled.

Optionally, according to one or more embodiments, the determining for operation 224 can be with respect to individual portions of the working depth of the rotor 118. For instance, the determining can be made with respect to the left portion of the rotor 118, the right portion of the rotor 118, and/or the center portion of the rotor 118 between the left and right portions, for instance, based on data received from the corresponding one or more image sensor(s) 140 and/or corresponding one or more sonic sensor(s) 142.

Figure 12:
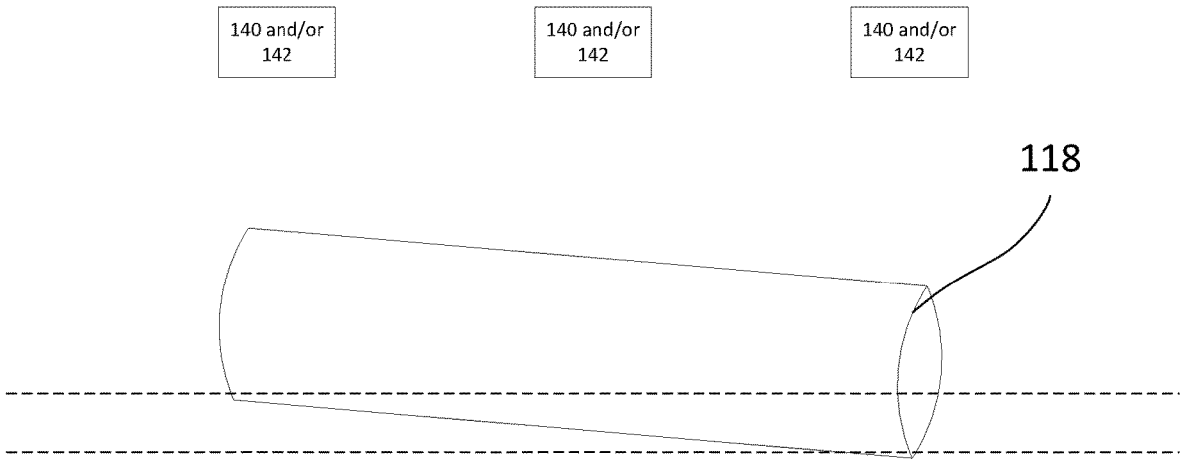
FIG. 12 is a diagram of a rotor cutting depth deviating from a target cutting depth according to one or more embodiments of the disclosed subject matter.

For instance, FIG. 12 illustrates, diagrammatically, only a right portion of the rotor 118 being outside (below in this case) a target cutting depth (between dashed horizontal lines). As noted above, data from one or more image sensors 140 and/or one or more sonic sensors 142 can be fed back to the processor 152 to determine whether some or all of the rotor 118 has deviated from the target cutting depth. Though FIG. 12 shows the right portion of the rotor 118 being angled with respect to the lines representative of the target cutting depth, the ground surface may instead be angled and the rotor 118 horizontal but the ground surface at the right side of the rotor 118 nevertheless is such that the cutting depth of the rotor 118 unsatisfactorily is outside of the target cutting depth. Moreover, though FIG. 12 shows deviation from the target cutting depth as being below the target cutting depth (i.e., too deep), embodiments of the disclosed subject matter can additionally or alternatively detect deviation in the form of above the target cutting depth (i.e., too shallow).

Operation 222 and operation 224 can continue to be performed unless the determined working depth of the rotor 118 is determined to deviate from the target working depth (e.g., at all or by a predetermined amount) or be outside of the target working depth range. In such a case, control can proceed to operation 226. The working depth of the rotor 118 may deviate from the target working depth based on changing working conditions, such as changes in the condition of the ground surface (e.g., hard or wet, raised and/or depressed portions, roughness, etc.) and arrangement of the milling machine 100, 101 (e.g., sinking in, speed, etc.).

Operation 226 can include adjusting the working depth of the rotor 118. Such adjustment can be to the target working depth or within the target working depth range. Alternatively, such adjustment can be to prevent the working depth of the rotor 118 from deviating from the target working depth or the target working depth range. Thus, embodiments of the disclosed subject matter can predict, based on data from one or more image sensors 140 and/or one or more sonic sensors 142 that the working depth of the rotor 118 is expected to deviate from the target working depth (or target working depth range) and make or time adjustments to prevent the working depth of the rotor 118 from deviating from the target working depth or the target working depth range. Accordingly, according to operation 226, embodiments of the disclosed subject matter can implement a substantially uniform working depth for the rotor 118 across a predetermined working distance, such as an entire working pass, for instance.

Adjustment can include changing a height of the rotor 118 and/or a height of the frame 102 based on movement of one or more of the legs 112, depending upon the need and configuration of the milling machine (i.e., fixed-frame or adjustable frame). According to one or more embodiments, adjustment can be with respect to individual portions of the working depth of the rotor 118. For instance, the adjustment can be made with respect to the left portion of the rotor 118, the right portion of the rotor 118, and/or the center portion of the rotor 118 between the left and right portions based on feedback data received from corresponding one or more image sensor(s) 140 and/or corresponding one or more sonic sensor(s) 142. For instance, if one portion of the rotor 118 is determined to require adjustment, such working depth adjustment can be performed with respect to one or more of the portions of the rotor 118 to move the one portion to the target working depth (or within the target working depth range) while also maintaining the other portions of the rotor 118 at the target working depth (or within the target working depth range). Such adjustment to move one portion of the rotor to the target working depth (or within the target working depth range) can also adjust other portions of the rotor 118, even if the other portions of the rotor 118 are at the target working depth (or within the target working depth range), while maintaining the other portions of the rotor 118 at the target working depth (or within the target working depth range). And, as noted above, such adjustment can be accomplished by adjusting the height of the rotor 118 without or without adjusting the height of the frame 102.

Operation 228 can involve assessing whether the adjusting of operation 226 has adjusted the working depth of the rotor 118 to an acceptable working depth. In this context, acceptable can mean whether the working depth of the rotor 118 has been adjusted to or within the predetermined amount of a target working depth (e.g., a target working depth range).

The adjustment for operation 226 and operation 228 can be controlled based on feedback from one or more sensors, such as one or more position sensors in one or more actuators to sense the height of the rotor 118, one or more position sensors in one or more actuators to sense respective heights of the legs 112, one or more of the image sensors 140, and/or one or more of the sensors 142. Thus, embodiments of the disclosed subject matter can implement the combination of position sensors that sense the height of the rotor 118 and the heights of the legs 112, along with one or more of the image sensors 140 and/or one or more of the sensors 142, to adjust working depth of the rotor 118 to an acceptable working depth.

The adjustment of operation 228 can be performed until the working height of the rotor 118 is determined to be acceptable. Control may then proceed to operation 214 of FIG. 10.

At operation 214 the method 200 can involve determining whether a control input to perform another return to cut operation is received or a control input to perform another operation, such as an exit cut operation is received. Such control input can be received at the operator control interface 134, and the controller 152 can monitor whether a control signal corresponding to the control input to perform another operation is received.

If the former, control can proceed to operation 204 or even operation 206 if, for instance, the settings are already available to the controller 152 without the need to access the memory 154. As an example, the operator may choose to initiate another return to cut operation during a same cutting pass to "rezero" or otherwise return the milling machine 100, 101 to desired settings to achieve a desired outcome if during the cutting operation the milling machine 100, 101 deviates from the settings of the previous return to cut operation due to a change in milling-related conditions, such as the condition of the surface layer (e.g., gets harder or softer). Generally, the return to cut operation may be more involved that the rotor height adjustment of operation 212 in that the rotor height adjustment of operation 212 may not involve adjustment of the front door 124 and/or the rear door 126. If the latter, control can proceed to operation 300 to perform an exit cut operation.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A rotary mixer comprising:

an operator control interface;

a frame having a plurality of legs;

a rotor configured to process ground surface material;

a mixing chamber, the rotor being provided at least partially in the mixing chamber;

a plurality of sonic sensors positioned to respectively sense left, right, and center rotor cutting heights of the rotor; and a controller configured to automatically control height of the rotor to adjust a rotor cutting height for the rotor to a target cutting height stored in memory and accessible by the controller responsive to a control input received at the operator control interface and based on data from the plurality of sonic sensors representative of left, right, and center rotor cutting heights of the rotor, wherein the height of the rotor is adjustable relative to the mixing chamber, wherein the legs are adjustable to control the height of the rotor relative to a ground surface, wherein the adjustment of the height of the rotor relative to the mixing chamber is independent of the adjustment of the legs to control the height of the rotor relative to the ground surface, and wherein the adjustment of the rotor cutting height to the target cutting height includes individually adjusting one or more of the left, right, and center rotor cutting heights of the rotor by selective control of heights of the legs of the rotary mixer and/or the height of the rotor relative to the mixing chamber to change a roll orientation of the rotor.

2. The rotary mixer according to claim 1, wherein the controller is configured to adjust the rotor cutting height multiple times over a single milling pass between an automated or manual return to cut operation and an automated or manual exit cut operation, responsive to respective control inputs received at the operator control interface.

3. The rotary mixer according to claim 1, wherein at least one of the plurality of sonic sensors is forward of the mixing chamber and at least one of the plurality of sonic sensors is aft of the mixing chamber.

4. The rotary mixer according to claim 1, wherein the controller is configured to control the legs and the rotor to control the height of the rotor to adjust the rotor cutting height for a return to cut operation and control only the rotor to adjust the rotor cutting height relative to the mixing chamber during a normal mixing operation of the rotary mixer.

5. The rotary mixer according to claim 1, wherein the controller is configured to perform prediction analysis based on feedback from one or more of the sonic sensors and/or one or more image sensors of the rotary mixer to automatically control the height of the rotor to adjust the rotor cutting height for the rotor such that the height of the rotor is prevented from deviating from the target cutting height.

6. A system comprising:

a rotor of a rotary mixer configured to process ground surface material and having a cutting height movable based on movement of a mixing chamber that contains the rotor between a fully extended height and a fully retracted height;

a plurality of sensors, each of the sensors being one of a sonic sensor or a camera; and a controller configured to automatically adjust a rotor cutting height of the rotor to a target cutting height based on a control input received at an operator control interface of the rotary mixer and based on continuously received data from the plurality of sensors indicating that the rotor cutting height has deviated from the target cutting height by a predetermined amount, the continuously received data including data that is representative of left, right, and center rotor cutting heights of the rotor, wherein height of the rotor is movable via height adjustment of one or more legs of the rotary mixer and via independent cutting height adjustment of the rotor based on movement of the mixing chamber with or without the height adjustment of the one or more legs, and wherein the adjustment of the rotor cutting height to the target cutting height includes individually adjusting one or more of the left, right, and center rotor cutting heights of the rotor by selective control of heights of the legs of the rotary mixer and/or the height of the rotor relative to the mixing chamber to change a roll orientation of the rotor.

7. The system according to claim 6, wherein, during a normal cutting operation of the rotary mixer, the controller controls only movement of the mixing chamber to adjust the rotor cutting height to the target cutting height and not any of the legs, and wherein the controller is configured to adjust the rotor cutting height multiple times over a single milling pass between an automated or manual return to cut operation and an automated or manual exit cut operation, responsive to respective control inputs received at the operator control interface.

8. The system according to claim 6, wherein the controller controls movement of one or more legs of the rotary mixer independent of movement of the mixing chamber to adjust the rotor cutting height to the target cutting height.

9. The system according to claim 6, wherein the target cutting height is stored in memory accessible by the controller.

10. The system according to claim 6, wherein at least one of the sensors is the camera, the camera being provided at one side of the rotary mixer to capture images of a bottom portion of a mixing chamber of the rotary mixer that contains the rotor, and wherein the controller is configured to adjust the height of the rotor via the height adjustment of the one or more legs using data from the camera regarding the images of the bottom portion of the mixing chamber of the rotary mixer.

11. A method comprising:

receiving, using a processor of a mixing machine, signals from one or more sensors;

determining, using the processor of the mixing machine, whether a cutting height of a rotor of the mixing machine is within a predetermined range of a target cutting height based on said receiving the signals from the one or more sensors; and adjusting, using the processor of the mixing machine, the cutting height of the rotor to the target cutting height based on a control input at an operator control interface of the mixing machine and when said determining determines that the cutting height of the rotor is outside the predetermined range of the target cutting height, wherein said adjusting of the cutting height of the rotor involves changing position of the rotor relative to a mixing chamber within which the rotor is provided independent of any raising or lowering of the rotor using one or more legs of the mixing machine, wherein the signals from the one or more sensors are representative of left, right, and center rotor cutting heights of the rotor as said cutting height of the rotor, and wherein said adjusting the cutting height of the rotor to the target cutting height includes individually adjusting one or more of the left, right, and center rotor cutting heights of the rotor by selective control of heights of the legs of the rotary mixer and/or the height of the rotor relative to the mixing chamber to change a roll orientation of the rotor.

12. The method according to claim 11, wherein said adjusting the cutting height of the rotor includes the raising or lowering the one or more legs of the mixing machine and the raising or lowering the rotor independent of the raising or lowering of the one or more legs to adjust the cutting height of the rotor to the target cutting height.

13. The method according to claim 11, further comprising controlling the one or more legs and the rotor to control a height of the rotor to adjust the cutting height of the rotor for a return to cut operation and performing said adjusting for only the rotor relative to the mixing chamber upon completion of the return to cut operation.

14. The method according to claim 11, wherein said adjusting the rotor cutting height is performed multiple times over a single milling pass between an automated or manual return to cut operation and an automated or manual exit cut operation, responsive to respective control inputs received at the operator control interface.

* * * * *